US009282596B2

(12) United States Patent
Wang

(10) Patent No.: US 9,282,596 B2
(45) Date of Patent: Mar. 8, 2016

(54) INTELLIGENT LIGHTING SYSTEM

(71) Applicant: Power Gold LLC, Phoenix, AZ (US)

(72) Inventor: James Jen-Ho Wang, Phoenix, AZ (US)

(73) Assignee: POWER GOLD LLC, Phoenix, AZ (US)

( * ) Notice: Subject to any disclaimer, the term of this patent is extended or adjusted under 35 U.S.C. 154(b) by 80 days.

(21) Appl. No.: 13/694,569

(22) Filed: Dec. 13, 2012

(65) Prior Publication Data

US 2014/0167618 A1 Jun. 19, 2014

(51) Int. Cl.
*H05B 37/02* (2006.01)
*H05B 33/08* (2006.01)

(52) U.S. Cl.
CPC ..... *H05B 33/0803* (2013.01); *H05B 33/0815* (2013.01); *H05B 33/0857* (2013.01)

(58) Field of Classification Search
CPC ..... H05B 33/0803; H05B 33/0815; H05B 33/0818; H05B 33/0854; H05B 37/029; H05B 37/0254; H05B 41/2855; H05B 33/0863; H05B 33/0842; H05B 37/0245; H01J 13/32; H01J 13/34; Y02B 20/202; F21K 9/00; F21V 29/2262; F21V 15/011; F21V 15/013; F21V 21/30; F21V 29/00; F21V 29/54; F21Y 2103/003; F21Y 2105/001; F21Y 2101/02; F21Y 2101/024; H01L 33/645; H01L 33/647; H01L 35/30
USPC ..... 315/113, 291, 294, 297, 307–309, 312, 315/316, 318; 362/249.02, 800, 225, 221, 362/227, 240, 249.05, 249.06, 294, 373; 136/205, 207
See application file for complete search history.

(56) References Cited

U.S. PATENT DOCUMENTS

| | | | | |
|---|---|---|---|---|
| 4,298,869 | A * | 11/1981 | Okuno | 345/82 |
| 6,166,496 | A * | 12/2000 | Lys et al. | 315/316 |
| 6,265,984 | B1 | 7/2001 | Molinaroli | |
| 7,178,941 | B2 * | 2/2007 | Roberge et al. | 362/225 |
| 7,358,929 | B2 * | 4/2008 | Mueller et al. | 345/1.3 |
| 8,159,152 | B1 * | 4/2012 | Salessi | 315/309 |
| 8,207,821 | B2 * | 6/2012 | Roberge et al. | 340/9.11 |
| 8,215,802 | B2 | 7/2012 | Bailey | |
| 8,256,921 | B2 | 9/2012 | Crookham et al. | |
| 8,274,397 | B2 | 9/2012 | Wilson et al. | |
| 8,450,670 | B2 * | 5/2013 | Verfuerth et al. | 250/205 |
| 8,491,159 | B2 * | 7/2013 | Recker et al. | 362/276 |
| 8,729,833 | B2 * | 5/2014 | Chemel et al. | 315/308 |
| 8,742,245 | B2 * | 6/2014 | Beasley | F21V 29/004 136/205 |

* cited by examiner

*Primary Examiner* — Haissa Philogene
(74) *Attorney, Agent, or Firm* — Edward James Mischen

(57) ABSTRACT

Intelligent lighting system 100 is configured to operate from an AC source 12. An array of visible light emitting diodes (LEDs) 124 responds to environmental room conditions monitored by a sensor circuit. A microcontroller 146 operates in response to sensor circuit communications to control the state of the visible light array. An internal low noise voltage source VL is derived from the waste heat product from a portion of the LED array. The low noise voltage source is used to power the sensor circuit and the microcontroller.

20 Claims, 6 Drawing Sheets

INTELLIGENT LIGHTING SYSTEM

The following patent application is based upon and claims priority from U.S. provisional patent applications Nos. U.S. 61/630,536 and U.S. 61/630,535 co-filed Dec. 14, 2011.

BACKGROUND OF THE INVENTION

The present invention relates generally to green lighting systems and more particularly to environmentally adaptive lighting systems.

Present day lighting systems are manufactured using incandescent light bulbs, fluorescent tubes, or light emitting diodes (LEDs) incorporated within heavy, bulky assemblies. The assemblies require separate manually controlled power sources that lack flexible options for controlling the assemblies.

Generally, the light assemblies operate in a pseudo digital mode. They are either on or off. Attempts to add adaptability, e.g., light dimming, require the use of manual controls and the addition of bulky dimming control modules.

Existing LED strings, of various colored lights, are programmed for on-off functions and ripple functions, but the LED string function must be physically pre-programmed and is not adaptable to changing conditions within a lighted area.

Computers are used to manually program light systems, however, the systems require external control modules for each lighting assembly, and once programmed, lack adaptable flexibility. The system must be reprogrammed to alter the lighting system performance.

Today's office lighting systems are costly, inefficient, bulky, and rely heavily on manual input to adjust brightness or turn off sections of lights where sunlight is present. Adaptively illuminating large areas is generally accomplished at the expense of manually removing unneeded bulbs, resulting in wasted space and limited flexibility in lighting options.

Therefore, what is needed is a cost effective, minimum footprint, power efficient, environmentally adaptive, automated lighting system that responds to environmental conditions with minimized requirements for manual input.

SUMMARY OF THE INVENTION

In accordance with an embodiment, an intelligent system for sensing environmental conditions within a large electrically lighted room area and efficiently responding to the need for the changing environmental conditions of the area by automatically adapting the lighting conditions to meet the environmental needs is provided.

In the inventive process, an intelligent lighting system module is initially powered on by an alternating current (AC) signal. The AC signal is converted to a DC power source. The DC power source provides power to sensors, transmitter/receivers, clock, and microcontrollers. The LED lighting arrays are activated in response to signals from an internal system calendar clock and from environmental sensor circuits. The arrays are configured with visible and/or ultraviolet (UV) LEDs, i.e., lighting elements, and/or infrared (IR) LEDs, i.e., heating elements. The arrays may be configured with multiple LEDs, or alternatively a single LED. A pre-programmed micro-controller processes activation information from the clock and sensor circuits to provide control signals to the LED lighting arrays to adaptively control lighting conditions within the room, thus excluding the need for manual intervention in the lighting system.

The visible LED arrays are configured in a fashion, for example, one array directed toward the east side area of a room, and one array directed toward the west side area of a room. The LED lighting arrays respond to various room conditions such as time of day, amount of sunlight present, and the presence of people and activity within the room. Additional LED arrays are added to further divide the room into environmentally controlled areas.

Likewise, IR LED arrays are configured to provide adaptive heating to desired areas of the room. In a similar manner, UV LED arrays provide artificial sunlight conditions to enhance health benefits, e.g., absorption of vitamin E and production of vitamin D to specific room areas of human activity.

Within the intelligent lighting system, a thermo electric generator (TEG) converts wasted thermal energy, from a portion of the LED arrays, to a low noise isolated power supply, for powering the micro-controller, sensors, calendar clock, transmitters/receivers, and other discrete and integrated circuit components within the intelligent lighting system.

Consequently, the intelligent lighting system automatically responds to environmental conditions within a room and adapts the lighting system to effectively alter the environmental conditions of the room without manual intervention.

DETAILED DESCRIPTION OF THE DRAWINGS

In accordance with an embodiment, the present invention comprises an intelligent lighting system configured for responding to environmental conditions within a room and producing associated outputs as required by the environmental requirements.

Figure 1:
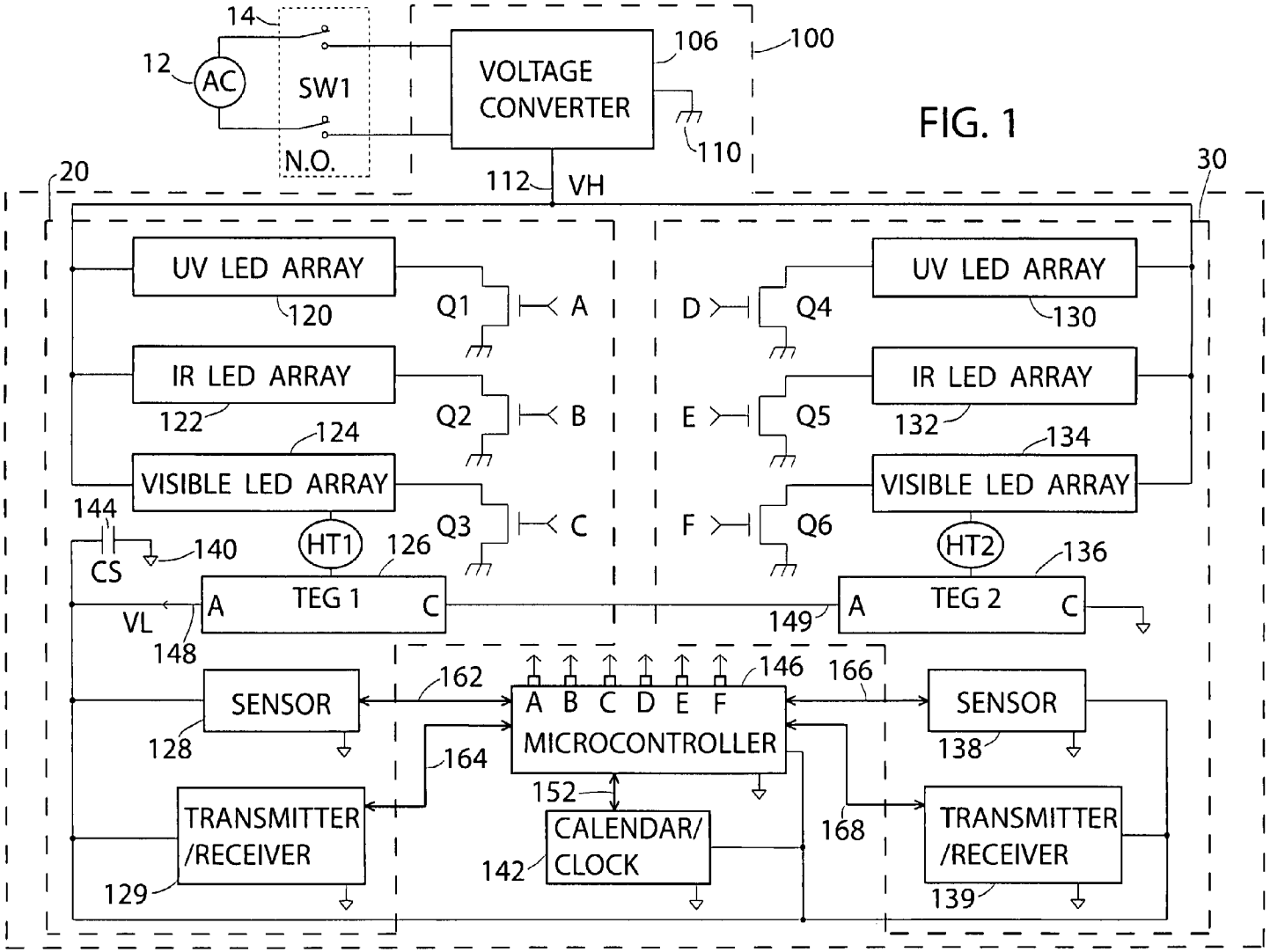
FIG. 1 is a system diagram of an intelligent lighting system in accordance with an embodiment of the present invention.

Referring to FIG. 1, an embodiment of intelligent lighting system module 100 of the present invention is shown. The intelligent lighting system includes voltage converter circuit 106, intelligent lighting modules 20 and 30, calendar/clock circuit 142, and microcontroller 146.

In FIG. 1, converter circuit 106 inputs are connected to AC power source 12 through normally open switch SW1 14. The converter is grounded through ground terminal 110. Output terminal 112 voltage VH of the converter is connected to an anode terminal of UV LED array 120, IR LED array 122, and visible LED array 124 of intelligent lighting module 20.

The cathode outputs of the UV LED array, the IR LED array, and visible LED array are connected respectively to the drain terminals of FET transistors Q1, Q2, and Q3.

Output terminal 112 voltage VH of the converter is further connected to an anode terminal of UV LED array 130, IR LED array 132, and visible LED array 134 of intelligent lighting module 30.

The cathode outputs of the UV LED array, the IR LED array, and visible LED array are connected respectively to the drain terminals of FET transistors Q4, Q5, and Q6.

Figure 1B:
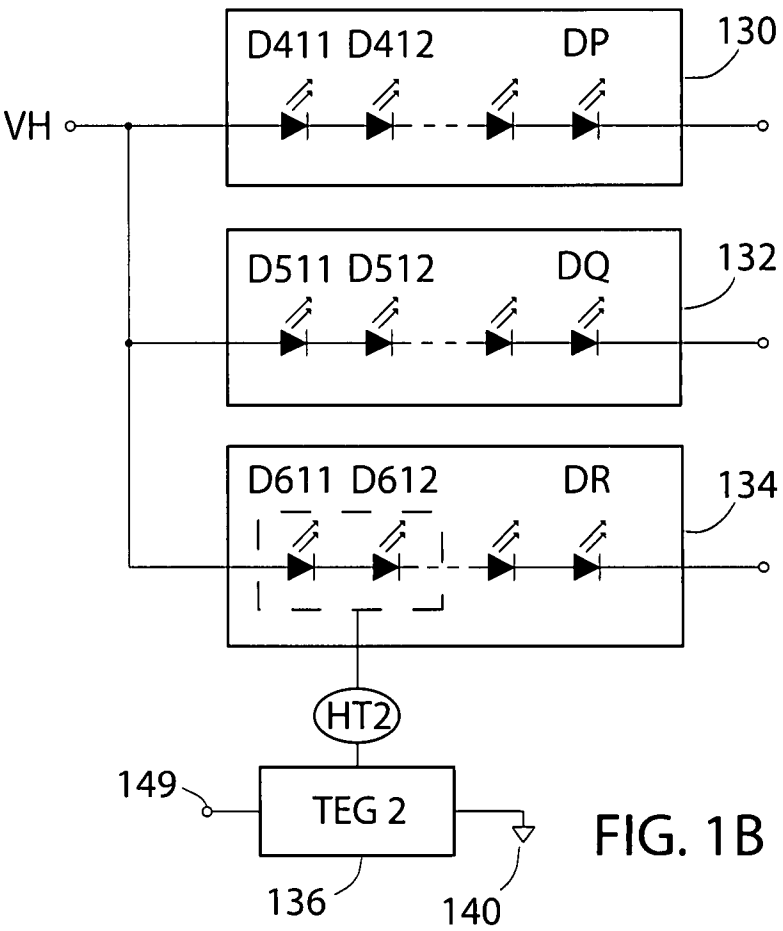
FIG. 1B is a circuit diagram of a portion of the intelligent lighting system of FIG. 1 in accordance with another embodiment of the present invention.
Figure 1A:
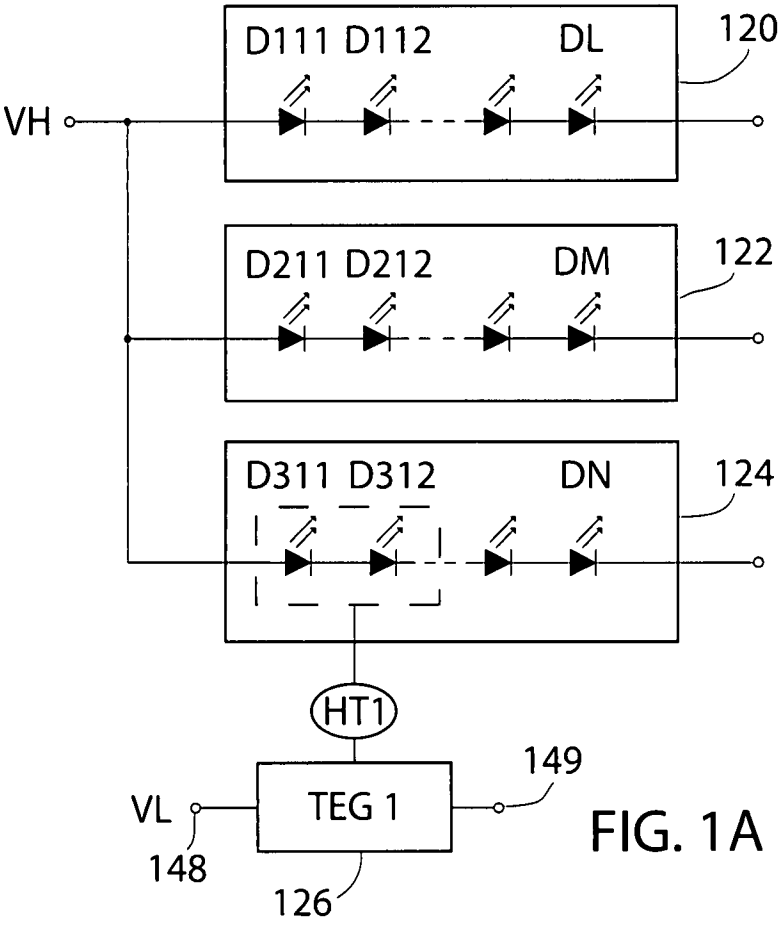
FIG. 1A is a circuit diagram of a portion of the intelligent lighting system of FIG. 1 in accordance with an embodiment of the present invention.

Further detail of the LED arrays is provided in FIG. 1A and FIG. 1B.

FET transistors Q1, Q2, Q4, and Q5 are biased to a normally off position with resistor dividers (not shown) connected between output terminal 112, and ground terminal 110 with respective tap points connected to the respective gates of the transistors. FET transistors Q3 and Q6 are biased to a normally on position with resistor dividers (not shown) connected between output terminal 112, and ground terminal 110 with respective tap points connected to the respective gates of the transistors. Alternatively, different biasing schemes, as known to those skilled in the art, are used to bias the respective FET transistors.

The source terminals of FET transistors FET transistors Q1, Q2, Q3, Q4, Q5, and Q6, are connected in common to ground terminal 110.

Waste heat products HT1 and HT2, generated by visible LED arrays 124 and 134, are transferred to thermo-electric generators TEG1 126 and TEG2 136, respectively, to produce voltage outputs at terminals 148 and 149.

The cathode terminal of TEG2 is connected to low noise ground terminal 140. Anode terminal 149 of TEG2 is connected serially to the cathode terminal of TEG1. Anode terminal 148 of TEG1 produces low noise supply voltage VL at terminal 148. Further detail of the LED/thermo-electric generator interface is shown in FIG. 3.

Low noise supply voltage provides power for sensor circuit 128, transmitter/receiver circuit 129, micro-controller 146, calendar/clock circuit 142, sensor circuit 138, and transmitter/receiver circuit 139. The sensor circuits, transmitter/receiver circuits, micro-controller, and calendar/clock circuit share a common low nose ground connected at ground terminal 140.

Capacitor CS 144, is connected between low noise voltage supply terminal 148 and low noise ground terminal 140. The capacitor serves as a storage element to maintain power to the respective circuits when switch SW1 14 is placed in the open position. Alternatively, the storage element is a battery or other storage elements known to those skilled in the art.

Two-way communication between micro-controller 146 and sensor circuit 128, transmitter/receiver circuit 129, calendar/clock circuit 142, sensor circuit 138, and transmitter/receiver circuit 139 is provided by communication links 162, 164, 152, 166, and 168, respectively.

Control signals A, B, C, D, E, and F from micro-controller 146 are connected to the gates of FET transistors Q1, Q2, Q3, Q4, Q5, and Q6, respectively, for controlling the on-off states of the FET transistors. Thus, in turn, controlling the conduction states for the respective LED arrays. Alternatively, one skilled in the art would recognize such control signals can be generated in a serial fashion.

Referring again to FIG. 1, the intelligent lighting system operates as follows. Alternating line voltage source 12 is applied to the input of voltage converter 106 upon closure of normally open switch 14. The voltage converter produces a full wave rectified voltage output that is referenced to module power ground terminal 110. Further detail of voltage converter 106 is found in FIG. 2.

The output of the voltage converter is a full wave rectified voltage. The voltage output provides power to the UV LED arrays, the IR LED arrays, and the visible LED arrays of intelligent lighting modules 20 and 30.

Transistors Q1, Q2, Q4, and Q5 are initially biased to an off condition. Thus the associated LED arrays are in a powered off state.

Transistors Q3 and Q6 are initially biased to an on condition, causing the associated visible LED arrays to conduct and thus generated light and waste heat energy.

Referring briefly FIG. 1A, wasted heat energy HT1 from diodes D311 and D312 of visible LED array 124 is thermally transferred to thermo-electric generator 126. The thermo-electric generator converts the wasted heat energy into a voltage source between terminals 148 and 149. Since there is no electrical connection between the generated voltage and the wasted heat source, the thermally generated voltage source exhibits extremely low noise characteristics.

Referring now to FIG. 1B, wasted heat energy HT2 from diodes D611 and D612 of visible LED array 134 is thermally transferred to thermo-electric generator 136. The thermo-electric generator converts the wasted heat energy into a voltage source at terminal 149.

FIG. 1A and FIG. 1B, show LED arrays configured with multiple diodes connected in series. Alternatively, each array may be configured with a single diode to add flexibility of implementation within a room lighting system environment.

Referring back to FIG. 1, the thermo-electric voltage sources are connected in series to generate approximately a low noise supply voltage VL of 5.0*v* at terminal 148. The supply voltage is used to power the low voltage circuits, i.e., sensor circuits, transmitter/receiver circuits, calendar/clock, and micro-controller. The intelligent lighting system is now operationally functional.

Figure 5:
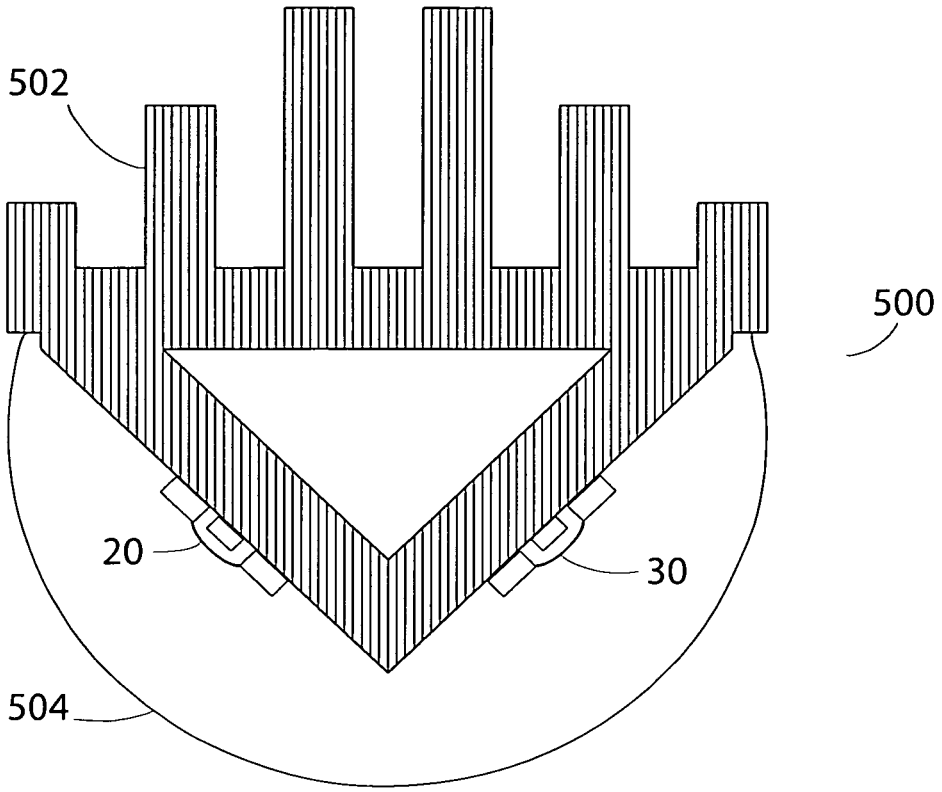
FIG. 5 is a cross-sectional view of another portion of the intelligent lighting system in accordance with an embodiment of the present invention.

Looking briefly to FIG. 5, a cross-sectional view replicating an implementation of a directional intelligent lighting system fixture 500 is shown. LED Modules 20 and 30 are mounted on a flexible circuit material (not shown), and the assembly is fastened to heat sink 502 utilizing a thermal adhesive. Alternatively, the method of fastening is, but is not limited to a mechanical means. The heat sink is, but is not limited to, aluminum. Alternatively, other heat sink materials, e.g., copper, composites, or ceramics are used. The heat sink is, in addition to dissipating heat, designed to facilitate an intelligent lighting system that responds to environmental conditions for each half of a room, e.g., an east side and a west side.

The intelligent lighting fixture is enclosed in a polycarbonate tube to complete the assembly, simulating the look and feel of a lighting assembly such as a fluorescent tube. The assembly, e.g., radiates light at up to 240 degrees or directionally in one axis depending upon whether one or both arrays of visible LEDs is powered on. Directionality and brightness of light is automatically controlled by the electronics of the intelligent lighting system.

For this example, the components of the intelligent lighting system are assembled with flexible film technology.

The directional characteristics of LEDs, allow the placement of sensor circuits within the intelligent lighting system assembly. The directional emissions of the LEDs, therefore, do not interfere with operation of the sensor circuits.

Referring again to FIG. 1 an example of an application of intelligent lighting system is demonstrated. The system is configured for attaching to an aluminum heat sink as shown in FIG. 5 to create directional intelligent lighting system fixture 500. The lighting fixture divides the room environment into an East half and a West half.

The micro-controller 146, is preprogrammed to respond inputs from calendar/clock circuit 142, to determine time, day, date, season setting, etc. The micro-controller is also programmed with desired lighting conditions to interface with control of the LED arrays. For example, summer sunlight hours are programmed to coincide with East versus West locations to minimize afternoon lighting for the West side of the room, while enhancing lighting conditions for the East side of the room.

Additionally, sensors 128 and 138 are, for example, motion sensors, and detect the presence of an individual presence in the West side of the room or the East side of the room and direct power to the appropriate visible LED arrays to provide an optimized environment for the room location and save energy where light is not required. Alternatively, sensors are, but are not limited to, thermal sensors, visible light sensors, and infrared sensors. Sensors may also include wireless communication devices, for example, to provide an interaction with a remote data transmission source such as a light source or cellular telephone.

The micro-controller, interfacing with the calendar/clock circuit, also directs control signals to the proper IR LED array to provide heat to a portion of the room when an individual is present and the season coupled with temperature sensing, dictates the need for supplemental RF heating within the environment.

The micro-controller is similarly programmed to control UV LED arrays to produce vitamin D, thus simulating directional artificial sunlight for the room environment.

Additional sensing and detection devices are, but are not limited to, light detectors, near field communication devices, and RF antenna arrays, for cellular phones. Cellular phones provide a forum to emit RF signals and location information with potential for generating personal environmental preference data to transmit to the intelligent lighting system transmit/receive circuits.

Figure 2:
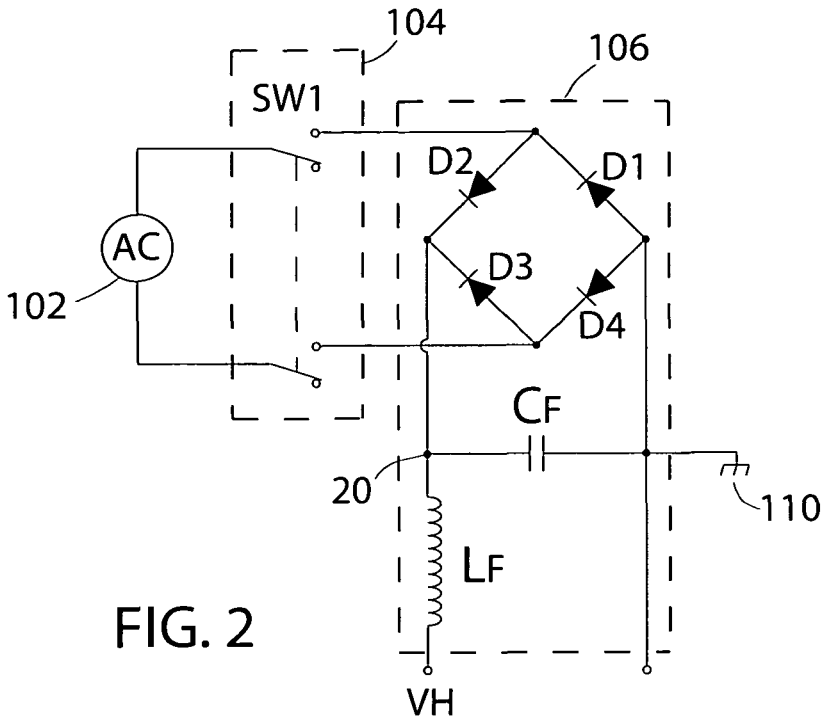
FIG. 2 is a circuit diagram of a portion of the intelligent lighting system of FIG. 1 in accordance with another embodiment of the present invention.

Referring now to FIG. 2, a detailed schematic of voltage converter 106, of FIG. 1, is shown.

Diodes D1, D2, D3, and D4 are connected in a full wave rectification configuration. Upon closure of switch SW1, AC signal 102, is applied across the anode terminal of diode D2, and the anode terminal of diode D3. A full wave rectified voltage signal is produced between terminal 20, and power ground terminal 110.

Capacitor CF and inductor LF are configured to filter and smooth rectified voltage signal at terminal 20 to produce output voltage VH.

Although the present embodiment reflects the use of a full wave rectified voltage converter for voltage converter 106, one skilled in the art would recognize the existence and applicability of alternative voltage converter circuits, e.g., but not limited to, an AC/DC inverter/converter circuit.

Looking now to FIG. 3, a simplified representation of the visible diode array/thermo-electric generator/heat sink interface is shown, i.e., interconnects and attachment means are removed for clarity. Further details are provided in the description of FIG. 4.

Diode pair D311 and D312 of visible LED array 124 is mounted atop thermo-electric generator 126. The assembly is then mounted atop heat sink 502. The remainder of the diodes within the array (through diode DN), are mounted atop the heat sink. Wasted heat generated by the diode pair is conducted through the thermo-electric generator (TEG), to the heat sink. For this example, the wasted heat develops a voltage range greater than 2.5 volts between anode terminal 148 and cathode terminal 149 of the TEG.

Likewise, diode pair D611 and D612 of visible LED array 134 is mounted atop thermo-electric generator 136. The assembly is then mounted atop heat sink 502. The remainder of the diodes within the array (through diode DR), are mounted atop the heat sink. Wasted heat generated by the diode pair is transferred through the thermo-electric generator (TEG), to the heat sink. For this example, the wasted heat develops a voltage range greater than 2.5 volts between anode terminal 149 and cathode terminal 140 of the TEG The respective voltages of the thermo-electric generators are connected in series to provide a approximate 5.0 volt low noise power source.

Figure 3A:
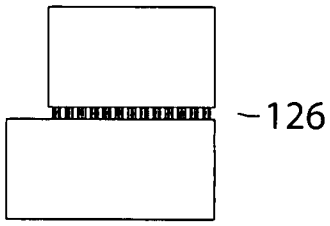
FIG. 3A is a cross-sectional view of a thermo-electric device in accordance with an embodiment of the present invention.
Figure 3:
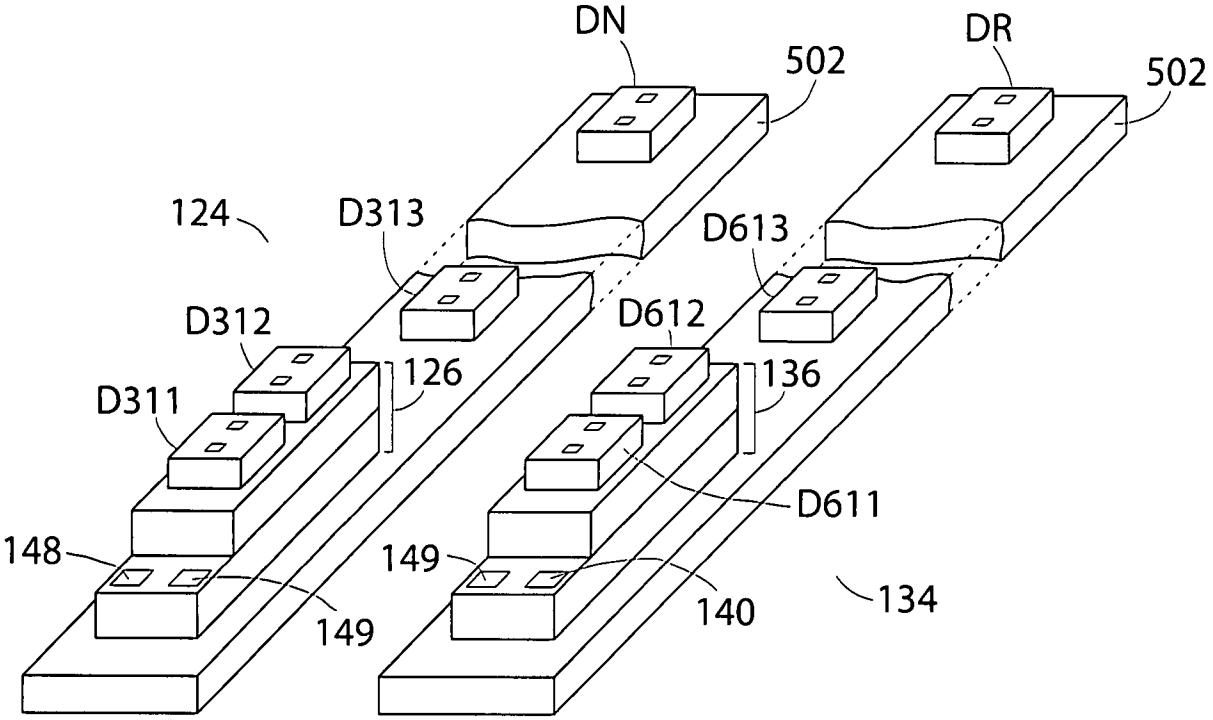
FIG. 3 illustrates an orthogonal view of an LED-thermo electric generator portion of the intelligent lighting system of FIG. 1 in accordance with an embodiment of the present invention.

FIG. 3A shows a cross-section of thermo-electric device 126. The TEG is a two layer device. For this example a pair of TEGs, known as Seebeck devices, are implemented to generated the required voltage from the amount of waste heat generated by the respective LED diode pairs. Alternatively, a single larger size LED, or an larger number of individual LEDs may be used to generate sufficient waste heat for adequate TEG voltage output. One skilled in the art would recognize available alternatives dependent upon the foregoing mentioned conditions.

Figure 4:
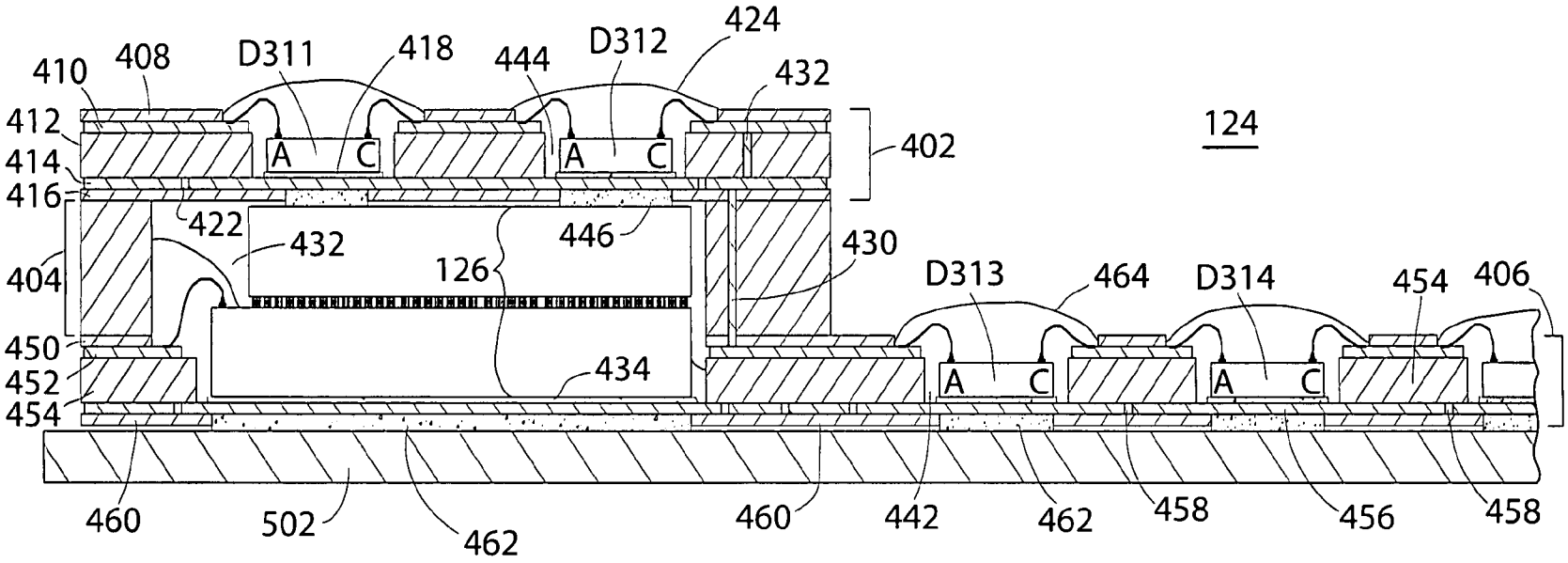
FIG. 4 is a cross-sectional view of an integrated LED-thermo-electric generator in accordance with an embodiment of the present invention.

Referring to FIG. 4, a cross-sectional view of visible LED array 124 (of FIG. 3) is shown.

Upper layer 402 and lower layer 406 are fabricated using flexible film assembly technology. Insulation/spacer layer 404 is fabricated using either FR4 or flexible film assembly technology. Aluminum heat sink layer 502 provides a path for conducting heat away from the visible LED array and also serves as a bottom thermal terminal for heat transfer of LEDs D311 and D312 through thermo-electric generator 126 to the aluminum heat sink layer. Alternatively, the heat sink layer is, but is not limited to, composites, ceramics, glasses, or copper. The heat sink layer also serves as a mounting base for intelligent lighting system 100. Copper interconnect layers and solder joints are not shown in complete detail, to simplify the drawing. Similarly, Interlayer adhesive layers are omitted and wire bond element numbers are omitted for simplicity. Further details of the flexible film and embedding process are found in U.S. patent application Ser. No. 13/506,110.

Lower layer 406 is fabricated using base insulation layer 460. Conductive layer 456 is attached to the insulation layer using, e.g., an adhesive (not shown). Likewise, insulation layer 454 is attached to conductive layer 456, and conductive layer 452 is attached to insulation layer 454. Conductive layer 452 facilitates interconnects and connection of the visible LEDs in a serial manner as shown in FIG. 1A. Metal gaps 458 are provided to separate predetermined conductor traces.

Pockets are formed in flexible base insulation layer 460, using for example a mechanical router cutting process. Pockets facilitate application of thermal adhesive 462, or alternatively a thermal grease, in the respective pockets. Pockets 442 are likewise provided to facilitate the embedding of visible LEDs D313 and D314, as well as TEG 126.

The LEDs are then covered with protective transparent coating 464 to complete assembly for lower layer 406.

Inner insulation/spacer layer 404 is attached to lower layer 406. Cavity 432 is formed to accommodate the embedding process of thermo-electric generator device 126. The insulation/spacer thickness is selected to accommodate the height of the thermo-electric device and for planarizing the surface of insulation/spacer layer structure for interfacing to upper layer 402. Via 430 works in conjunction with via 432 of upper layer 402 to provide a connection path between diode D312 and diode D313.

Insulation layer 416, of upper layer 402, serves as a base for the upper layer. Conducive layer 414 is affixed atop the insulation layer. Metal gaps 422 are placed within the conductive layer to separate electric contacts for diodes D311 and D312, and to provide electrical isolation for metal traces within the conductive layer. Insulation layer is affixed atop conductive layer using an adhesive (not shown)

Insulation layer 412 is likewise mounted to conductive layer 414 using an adhesive (not shown). The multilayer assembly of upper layer 402 is completed by mounting conductive layer 410 atop insulation layer 412, and by mounting and laminating insulation cover layer 408 atop conductive layer 410.

Pockets in insulation layer 416 are routed to facilitate dispensing of thermal adhesives 446, or alternatively thermal grease, and to provide a straightforward thermal path for diodes D311 and D312. The diodes are attached to conductive layer 414 using, for example, thermally conductive epoxy. The diodes are wire bonded (not labeled) to form connections for the upper layer of the visible LED array. The diodes next are covered with protective coating 424. The completed upper layer assembly is then attached to inner layer 404 using an adhesive and/or solder for attachment.

Higher temperature insulation layers used in fabrication of the upper and lower insulation layers are for example, but not limited to polyimide, liquid crystal polymer (LCP), or polyester.

Insulation layers the inner layer 404 fabrication are, but are not limited to, polyimide, polyester, impregnated paper, or printed circuit board (PCB).

Adhesives known in the art are used to attach the upper layer to the inner layer, and likewise attach the inner layer to the lower layer.

Electrical connections are soldered or joined with electrically conducting adhesive.

Inner-layer thermal adhesives 446 and thermal adhesives 462 are applied in sufficient quantity to squish out into vacant areas (shown but not labeled for simplicity) during the assembly process.

In the foregoing specification, the invention has been described with reference to specific embodiments, to specific materials, to specific processes, and to specific specifications. While specific embodiments of the present invention have been shown and described, further modifications and improvements will occur to those skilled in the art. It is understood that the invention is not limited to the particular forms illustrated, and it is intended for the appended claims to cover all modifications that do not depart from the spirit and the scope of this invention.

I claim:

1. An environmentally responsive intelligent lighting system comprising:

a light emitting diode array, wherein said light emitting diode array further comprises a plurality of lighting elements, each of said lighting elements having directional characteristics, said light emitting diode array coupled for receiving an alternating current signal at first and second terminals, wherein one or more of the lighting elements generates waste heat;

a sensor circuit configured for sensing an environmental condition, said sensor circuit further configured for generating an activation signal in response to said environmental condition, said sensor circuit coupled to a microcontroller through a communication link;

a thermo-electric generator configured to generate an output voltage in response to the waste heat; and said microcontroller configured to respond to said activation signal of said sensor circuit for controlling a conduction state of said light emitting diode array.

2. The environmentally responsive intelligent lighting system of claim 1, wherein said light emitting diode array is a visible light emitting diode array.

3. The environmentally responsive intelligent lighting system of claim 1, wherein said light emitting diode array is an ultraviolet light emitting diode array.

4. The environmentally responsive intelligent lighting system of claim 1, wherein said light emitting diode array is an infrared light emitting diode array.

5. The environmentally responsive intelligent lighting system of claim 1, wherein said sensor circuit is a motion sensor.

6. The environmentally responsive intelligent lighting system of claim 1, further comprising a transmitter receiver circuit coupled to said microcontroller for communicating environmental data to said microcontroller.

7. The environmentally responsive intelligent lighting system of claim 1, wherein said sensor circuit is a light sensor.

8. The environmentally responsive intelligent lighting system of claim 1, wherein said plurality of lighting elements is a single light emitting diode.

9. The environmentally responsive intelligent lighting system of claim 1, wherein said sensor circuit includes a transmitter/receiver circuit.

10. An environmentally responsive intelligent lighting system, comprising:

a light emitting diode array, wherein said light emitting diode array further comprises a plurality of lighting elements, each of said lighting elements having directional characteristics, said light emitting diode array coupled for receiving an alternating current signal at first and second terminals, said light emitting diode array having a capability for generation of a waste heat product;

a sensor circuit configured for sensing environmental conditions and further configured for generating an activation signal, said sensor circuit coupled to a microcontroller through a communication link; said microcontroller configured to respond to said activation signal of said sensor circuit for controlling a conduction state of said light emitting diode array; and a low noise voltage supply derived from said waste heat product of said light emitting diode array for powering said sensor circuit and said microcontroller.

11. The environmentally responsive intelligent lighting system of claim 10, wherein said light emitting diode array is a visible light emitting diode array.

12. The environmentally responsive intelligent lighting system of claim 10, wherein said light emitting diode array is an ultraviolet light emitting diode array.

13. The environmentally responsive intelligent lighting system of claim 10, wherein said light emitting diode array is an infrared light emitting diode array.

14. The environmentally responsive intelligent lighting system of claim 10, wherein said sensor circuit is a motion sensor.

15. The environmentally responsive intelligent lighting system of claim 10, further comprising a transmitter receiver circuit coupled to said microcontroller for communicating environmental data to said microcontroller.

16. The environmentally responsive intelligent lighting system of claim 10, wherein said sensor circuit is a light sensor.

17. The environmentally responsive intelligent lighting system of claim 10, wherein said plurality of lighting elements is a single light emitting diode.

18. The environmentally responsive intelligent lighting system of claim 10, wherein said sensor circuit includes a transmitter/receiver circuit.

19. An low noise voltage supply for an intelligent lighting system comprising: a light emitting diode array, wherein said light emitting diode array further comprises a plurality of lighting elements, said lighting elements configured for generating a waste heat product upon activation, said light emitting diode array coupled for receiving an alternating current signal at first and second terminals; and a one of said plurality of lighting elements configured for thermally coupling said waste heat product to a thermo-electric generator, said thermo-electric generator having a voltage output at a first terminal and a second terminal, wherein said voltage output is proportional to said one of said plurality of lighting elements waste heat product.

20. The low noise voltage supply of claim 19, wherein the plurality of light emitting elements comprises a plurality of light emitting elements selected from the group of light emitting elements comprising visible light emitting diodes, ultraviolet light emitting diodes, and infrared light emitting diodes.

* * * * *